United States Patent [19]

Sodeno et al.

[11] Patent Number: 4,641,424

[45] Date of Patent: Feb. 10, 1987

[54] APPARATUS FOR FINISHING SLIDE FASTENER CHAIN WITH REINFORCING STRIP

[75] Inventors: Toshiaki Sodeno, Toyama; Keiichi Yoshieda, Kurobe; Syuichi Honmoto, Uozu, all of Japan

[73] Assignee: Yoshida Kogyo K. K., Tokyo, Japan

[21] Appl. No.: 765,143

[22] Filed: Aug. 13, 1985

[30] Foreign Application Priority Data

Aug. 15, 1984 [JP] Japan ..... 59-124605[U]

[51] Int. Cl.[4] ..... A41H 37/06; B21D 53/50

[52] U.S. Cl. ..... 29/766; 29/33.2; 425/142; 425/545; 425/814

[58] Field of Search ..... 425/142, 289, 301, 306, 425/315, 545, 814, DIG. 34; 29/33.2, 34 A, 408, 766, 767; 264/40.1, 252

[56] References Cited

U.S. PATENT DOCUMENTS

| | | | |
|---|---|---|---|
| 2,478,880 | 8/1949 | Voity | 29/33.2 |
| 3,005,581 | 10/1961 | Burbank | 29/766 X |
| 3,763,546 | 10/1973 | Perlman | 29/408 |
| 4,265,014 | 5/1981 | Yoshieda et al. | 29/408 X |
| 4,307,500 | 12/1981 | Kuse | 29/408 X |
| 4,443,923 | 4/1984 | Takahashi | 29/33.2 X |
| 4,453,990 | 6/1984 | Takahashi | 29/408 X |
| 4,479,290 | 10/1984 | Osaki | 29/767 X |
| 4,505,659 | 3/1985 | Chijiishi et al. | 425/814 X |
| 4,516,304 | 5/1985 | Yoshida et al. | 29/766 X |
| 4,520,544 | 6/1985 | Morita et al. | 29/766 X |

FOREIGN PATENT DOCUMENTS

| | | |
|---|---|---|
| 55-118705 | 9/1980 | Japan . |
| 56-52561 | 12/1981 | Japan . |

*Primary Examiner*—Richard L. Chiesa

*Attorney, Agent, or Firm*—Hill, Van Santen, Steadman & Simpson

[57] ABSTRACT

A slide fastener chain with reinforcing strips is fed along a feed path through a finishing apparatus for trimming the reinforcing strips. The finishing apparatus has a chain guide unit, a cutter unit, and a chain tensioner unit. The chain guide unit includes a stop having recesses for accommodating some coupling elements and steps for engaging endmost coupling elements. The chain tensioner unit has a presser gripper for pressing the slide fastener chain against a support base and a presser roller for depressing the slide fastener chain to tension the same for thereby forcibly pushing the endmost coupling elements against the steps. When the slide fastener chain is tensioned by the chain tensioner unit, one of the reinforcing strips is accurately positioned with respect to the cutter unit. The reinforcing strip is then trimmed by central and side cutters which cut off excessive central and side portions completely.

8 Claims, 26 Drawing Figures

APPARATUS FOR FINISHING SLIDE FASTENER CHAIN WITH REINFORCING STRIP

BACKGROUND OF THE INVENTION

1. Field of the Invention

The present invention relates to an apparatus for finishing an elongate slide fastener chain, and more particularly to an apparatus for cutting off excessive or unnecessary portions from reinforcing strips or webs of synthetic resin film which are attached to an elongate slide fastener chain at regular longitudinally spaced intervals across element-free gaps or spaces of the chain, in the manufacture of separable slide fasteners having disengageable pin and box connectors mounted at ends thereof.

2. Description of the Prior Art

Separable slide fasteners have a box on an end of one slide fastener stringer and a pin on an end of the opposite or companion slide fastener stringer, the pin being removably inserted in the box for combining the stringers together. Such separable slide fasteners are manufactured from an elongate slide fastener chain composed of a pair of slide fastener stringers coupled together by a pair of intermeshing rows of coupling elements. The slide fastener chain has a plurality of reinforcing strips or webs attached to the stringer tapes across element-free gaps or spaces located at regular intervals along the chain. The slide fastener chain is cut off successively across the reinforcing strips to produce individual slide fastener lengths.

It has been customary practice to trim each of the reinforcing strips by removing excessive portions therefrom before the slide fastener chain is severed into the independent slide fastener lengths. Conventional arrangements for cutting off excessive portions from a reinforcing strip are disclosed in Japanese Laid-Open Patent Publication No. 55-118705 and Japanese Patent Publication No. 56-52561, for example. The disclosed arrangements have a vertically movable cutter punch for severing the reinforcing strip while the elongate fastener chain is positioned on a flat support surface. Since the stringer tapes are normally of woven or knit fabric, they can easily be varied dimensionally when stretched or tensioned. Therefore, the fastener chain tends to be displaced to bring the reinforcing strip out of alignment with the cutter punch. As a result, the conventional apparatus has failed to trim the reinforcing strip has been apt undesirably to leave a portion of the reinforcing strip uncut, which portion accurately, or keeps the fastener stringers interconnected.

SUMMARY OF THE INVENTION

It is an object of the present invention to provide an apparatus for finishing a slide fastener chain with reinforcing strips, the apparatus having means for accurately cutting off undesirable excessive portions from the reinforcing strips.

According to the present invention, an apparatus for finishing a slide fastener chain having a reinforcing strip includes a chain guide unit having a sensor for detecting the reinforcing strip and a stop movable transversely into a feed path in response to detection of the reinforcing strip by the sensor, the stop including steps for engaging the endmost coupling elements, respectively, of coupling element rows of a unit length to stop the slide fastener chain in the feed path. The apparatus also includes a cutter unit including a cutter movable transversely into the feed path for cutting off a central excessive portion from the reinforcing strip in response to engagement of the steps with the endmost coupling elements, and a pair of pressure pads disposed one on each side of the cutter for resiliently holding the slide fastener stringers in advance of the butting of the central excessive portion by the cutter. A chain tensioner unit disposed downstream of the cutter unit in the direction in which the slide fastener chain is fed along includes a presser gripper movable transversely into the feed path for resiliently holding the slide fastener chain in response to engagement of the steps with the endmost coupling elements, and a presser roller movable transversely into the feed path for tensioning the slide fastener chain in timed relation to the presser gripper to forcibly press the endmost coupling elements against the steps. Since the slide fastener chain is forcibly tensioned by the presser roller and gripped by the presser gripper, the reinforcing strip can be accurately positioned with respect to the cutter even if the slide fastener chain is stretched or dimensionally varied in the feed path. Therefore, the reinforcing strip can accurately and neatly be trimmed without leaving any unwanted pieces uncut.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
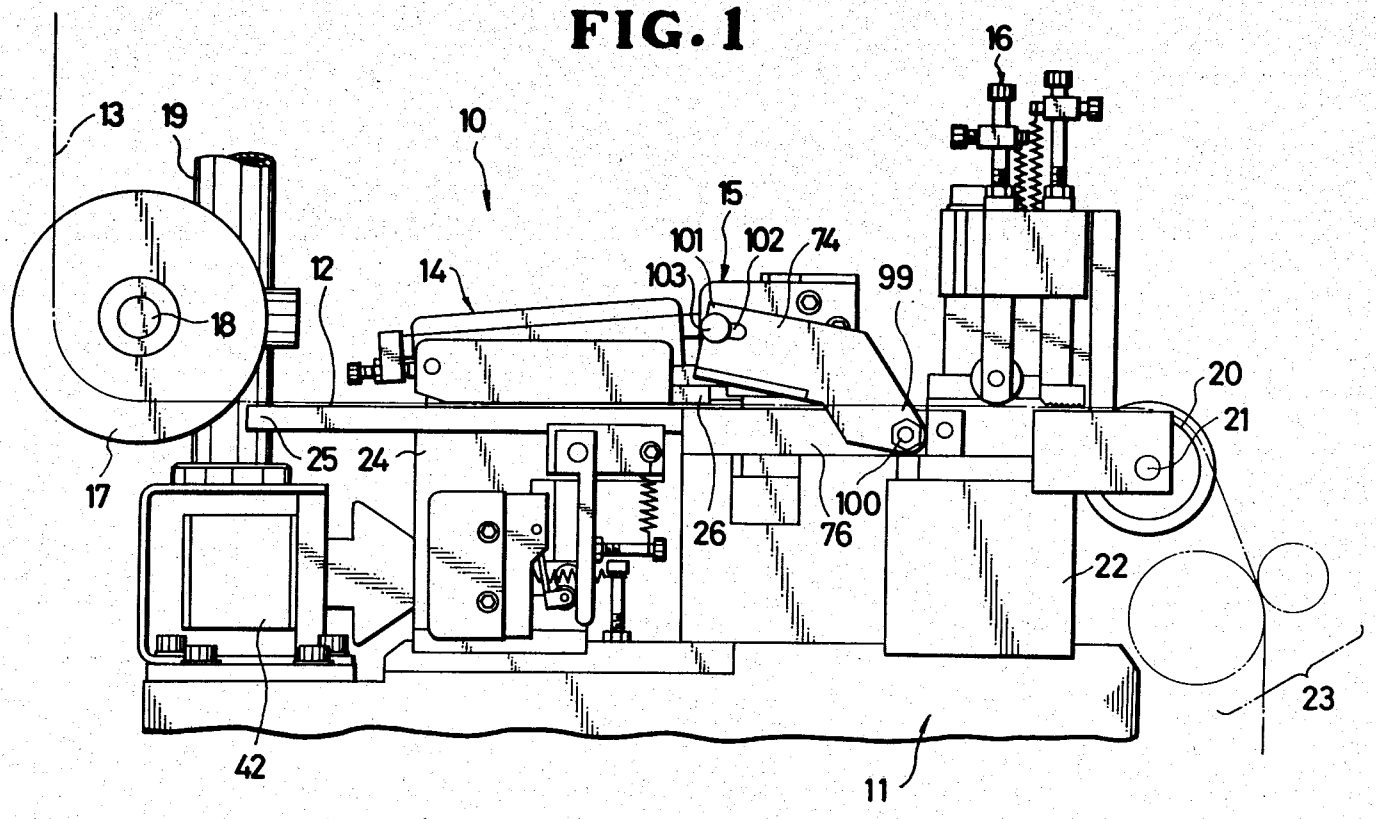
FIG. 1 is a side elevational view of an apparatus for finishing an elongate slide fastener chain with reinforcing strips.
Figure 2:
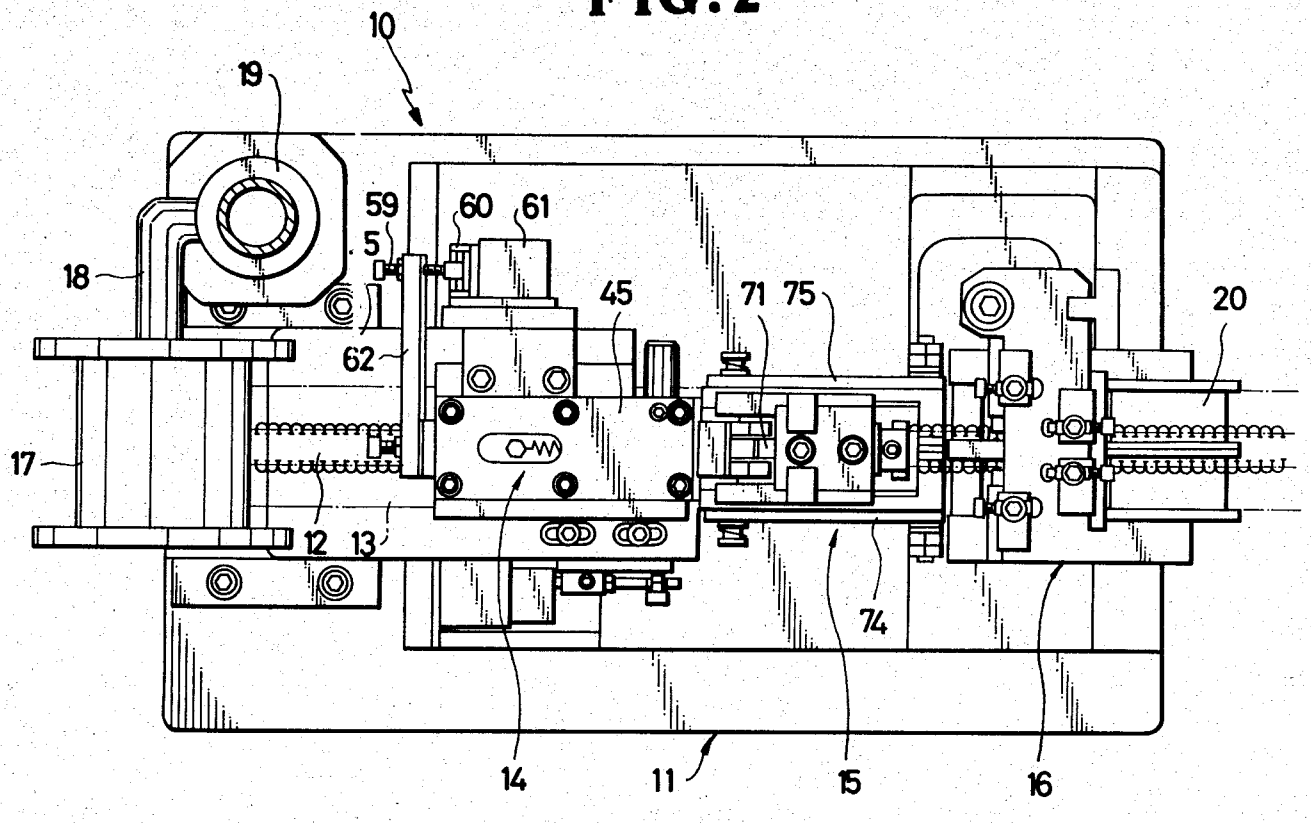
FIG. 2 is a plan view of the apparatus shown in FIG. 1.

The principles of the present invention are particularly useful when embodied in an apparatus for finishing an elongate slide fastener chain with reinforcing strips spaced at longitudinal intervals, the apparatus being generally indicated by the reference numeral 10 in FIGS. 1 and 2.

Prior to describing the finishing apparatus 10 in detail, a separable slide fastener and the manner in which reinforcing strips are applied to and trimmed on an elongate slide fastener chain will first be described with reference to FIGS. 21 through 26.

Figure 21:
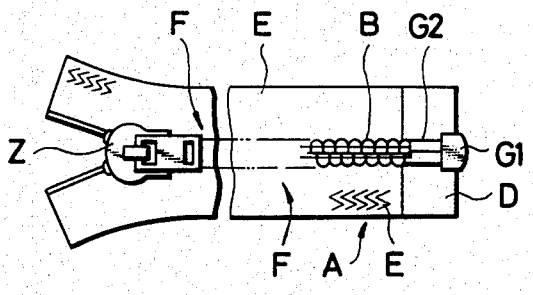
FIG. 21 is a plan view of a separable slide fastener.

FIG. 21 shows a separable slide fastener A composed of a pair on slide fastener stringers F having two intermeshing rows B of coupling elements mounted on the confronting edges of a pair of stringer tapes E of woven or knit fabric, the rows B of coupling elements being engageable and disengageable by a slider Z slidable therealong. A box G1 is attached to an end of one of the stringers F, and a pin G2 is attached to an end of the other stringer F, the pin G2 being removably inserted in the box G1. To stiffen the tape ends and prevent them from being unravelled, a reinforcing strip or web D of thermoplastic synthetic resin film is fixed to each of the stringer tapes E.

Figure 22:
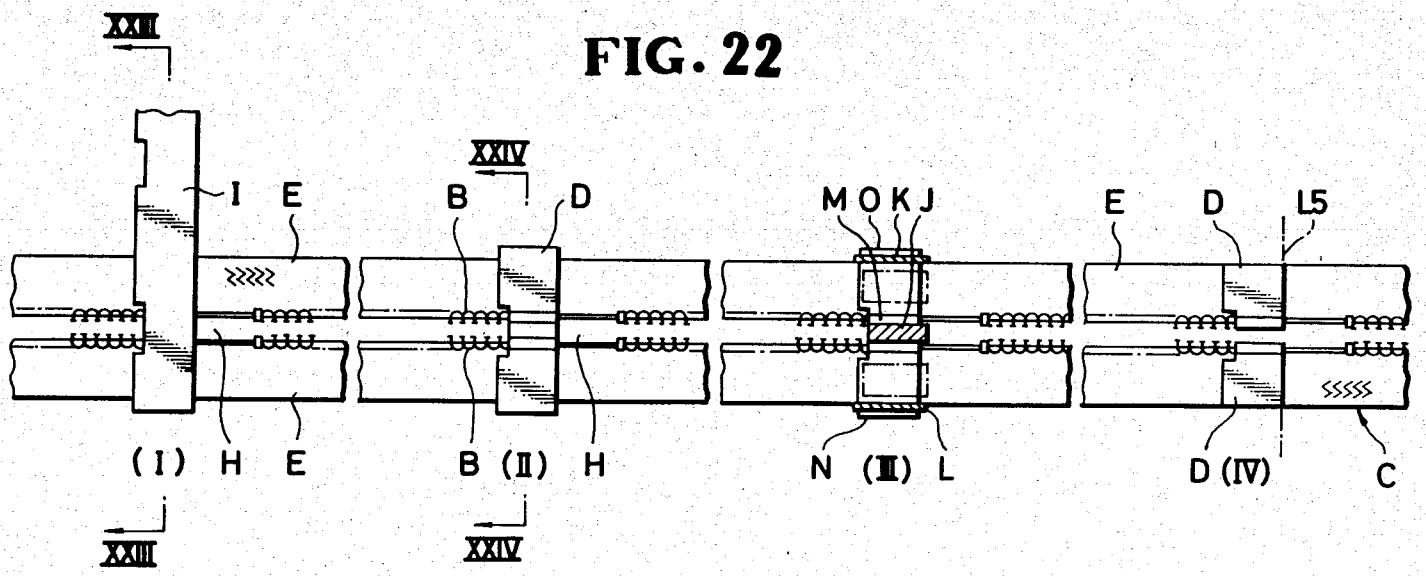
FIG. 22 is a fragmentary plan view of an elongate slide fastener chain having reinforcing strips spaced at longitudinal intervals, showing the manner in which the reinforcing strips are successively trimmed.
Figure 24:
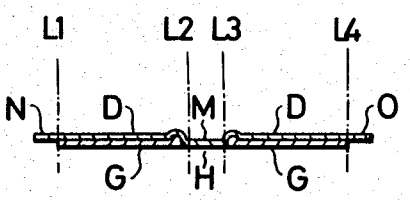
FIG. 24 is an enlarged cross-sectional view taken along line XXIV—XXIV of FIG. 22.
Figure 23:
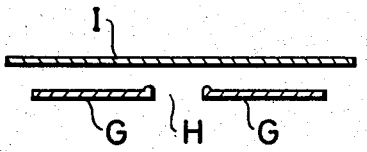
FIG. 23 is an enlarged cross-sectional view taken along line XXIII—XXIII of FIG. 22.

The slide fastener stringers F can be produced from an elongate slide fastener chain C (FIG. 22) having a pair of stringer tapes E with rows B of coupling elements mounted thereon. The slide fastener chain C also has a plurality of element-free gaps or spaces H spaced at longitudinal intervals. A reinforcing strip D is cut off from an elongate reinforcing strip blank I and fused to the tapes E across one of the element-free gaps H as shown in FIG. 22 at (I) and (II) and FIGS. 23 and 24. Then, as shown in FIG. 22 at (III) and FIG. 24, the reinforcing strip D is trimmed by cutters J, K, L by cutting off a central excessive portion M and side excessive portions N, O along lines L1 through L4. The slide fastener chain C is finally severed transversely along line L5 as shown at (IV) in FIG. 22 to produce an individual slide fastener length.

Figure 25:
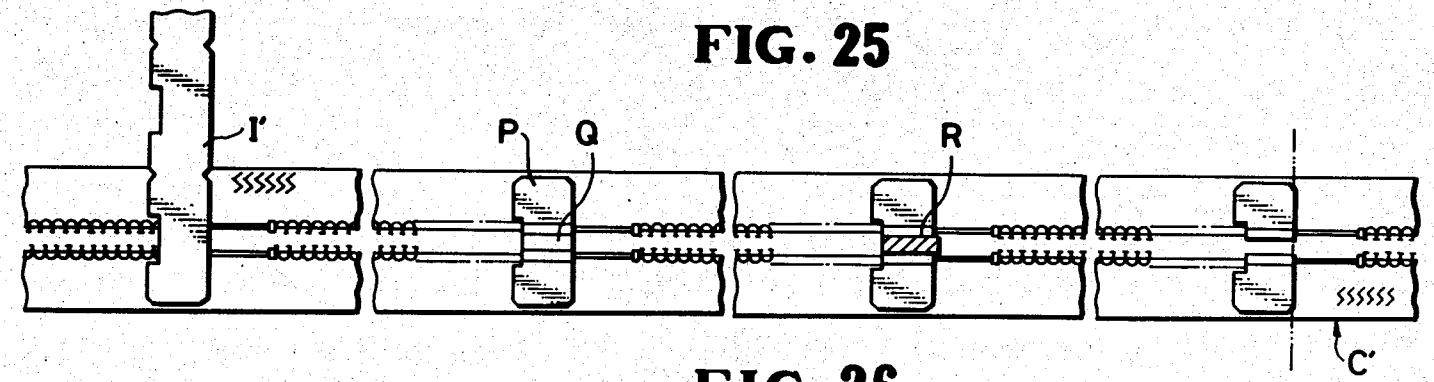
FIG. 25 is a fragmentary plan view of another elongate slide fastener chain having reinforcing strips spaced at longitudinal intervals, showing the manner in which the reinforcing strips are successively trimmed.

FIG. 25 shows another slide fastener chain C' having reinforcing strips P of a different shape which are cut off from an elongate reinforcing strip blank I'. Each of the reinforcing strips P has no side excessive portions and is trimmed only by cutting off a central excessive portion Q with a cutter R.

Figure 26:
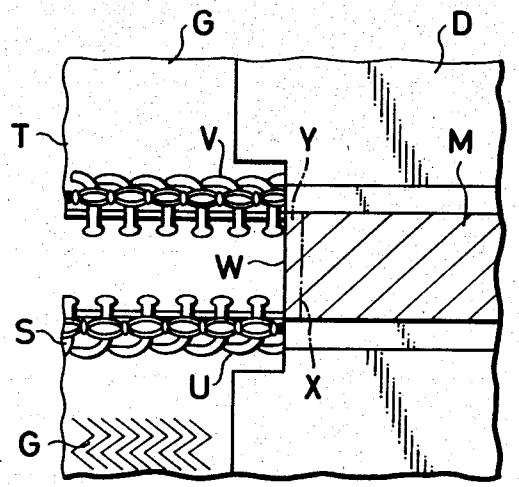
FIG. 26 is an enlarged fragmentary plan view of a portion of the slide fastener chain where a reinforcing strip is attached.

As illustrated in FIG. 26, the central excessive portion M has a recessed edge W held against the endmost coupling elements U, V of individual coupling element rows S, T, respectively, of a unit length. When trimming the reinforcing strip D, the entire central excessive portion M including the edge W has to be cut off completely to separate the slide fastener stringers from each other.

As disclosed in Japanese Laid-Open Patent Publication No. 55-118705 and Japanese Patent Publication No. 56-52561, it has been conventional practice to trim the reinforcing strip D by holding the slide fastener chain C on a flat support surface and cutting off the central excessive portion M and the side excessive portions N, O with a cutter punch. The cutter punch is vertically aligned with the edge W of the central excessive portion M by means of a positioning device. However, the reinforcing strip D is positioned simply by stopping the slide fastener chain C on the flat support surface.

The stringer tapes E are normally made of woven or knit fabric, and hence are easily subject to dimensional changes due to the stretching of the fabric fibers and variations in the tension of the stringer tapes E. In the conventional arrangements, the edge W of the central excessive portion M tends to be displaced such that the cutter punch cuts into the central excessive portion M at a position X, leaving a narrow bridge-like piece Y adjacent to the endmost coupling elements U, V. The residual bridge-like piece Y keeps the slide fastener stringers interconnected, and presents an obstruction in successive processing steps for producing separable slide fasteners.

The finishing apparatus 10 according to the present invention will now be described in detail.

As shown in FIGS. 1 and 2, the finishing apparatus 10 includes a base 11 and a horizontal feed path 12 defined above the base 11 for the passage of a slide fastener chain 13 having reinforcing strips or webs spaced at longitudinal intervals. The finishing apparatus 10 is essentially composed of a chain guide unit 14, a cutter unit 15, and a chain tensioner unit 16 arranged along the feed path 12 in the order named in the direction in which the slide fastener chain 13 is fed along the feed path 12.

A guide roller 17 is rotatably supported on a shaft 18 mounted on an upstanding column 19 mounted on the base 11. The guide roller 17 is positioned at the beginning end of the feed path 12 for guiding the slide fastener chain 13 into the feed path 12. Another guide roller 20 is rotatably supported on a shaft 21 mounted on a support block 22 mounted on the base 11. The guide roller 20 is positioned at the terminal end of the feed path 12 for guiding the slide fastener chain 13 out of the feed path 12. The slide fastener chain 13 as it is finished by the finishing apparatus 10 is discharged therefrom by a discharge roller assembly 23.

As illustrated in FIGS. 3 through 14, the chain guide unit 14 comprises a lower guide member 25 having an upper flat surface and mounted on a casing 24 disposed on the base 11, and an upper guide member 26 having a lower flat surface and supported on the casing 24. The feed path 12 is defined partly between the lower and upper guide members 25, 26 which are vertically spaced from each other.

The lower guide member 25 has a slot 27 in which there is disposed a feeler 28 of an L-shaped sensor 29 angularly movably mounted by a shaft 30 in the casing 24. The feeler 28 has an arcuate head 31 which normally projects upwardly into the feed path 12 beyond the upper surface of the lower guide member 25. The L-shaped sensor 29 also includes a downwardly extending leg 32 engaging the actuating arm 33 of a microswitch 34 housed in the casing 24. The leg 32 is normally urged by a spring 35 acting between the casing 24 and a stud 36 fastened to the leg 32 in a direction to keep the microswitch 34 unactuated and to cause the arcuate head 31 to project upwardly into the feed path 12. When the slide fastener chain 13 is fed along the feed path 12 and so long as no reinforcing strip enters the chain guide unit 14, the arcuate head 31 of the feeler 28 projects into the feed path 13 extends through a space 38 between coupling element rows 37 (FIG. 7), and the leg 32 does not push the actuating arm 33 of the microswitch 34.

Figure 8:
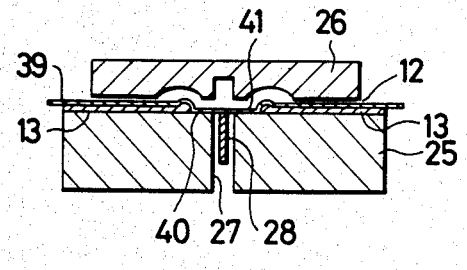
FIG. 8 is a view similar to FIG. 7, showing the sensor and the upper and lower guide members which are positioned when a reinforcing strip has reached the chain guide unit.
Figure 9:
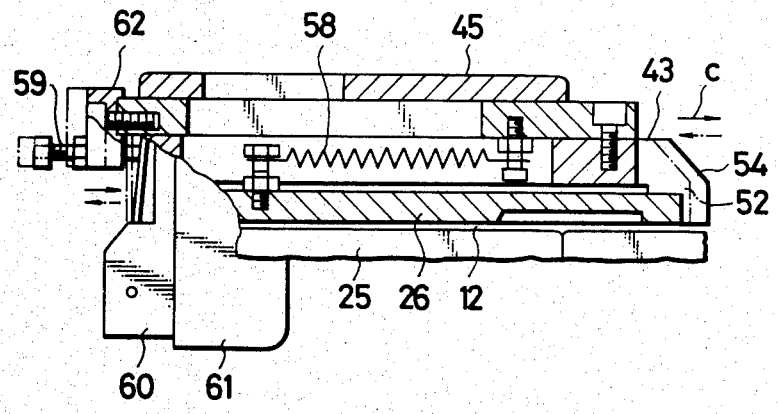
FIG. 9 is an enlarged vertical cross-sectional view of the chain guide unit, showing the manner in which the stop operates.

As shown in FIG. 8, a reinforcing strip 39 is attached to the slide fastener chain 12 across a space 40 between confronting tape edges and has a central excessive portion 41 lying in the space 40. When the reinforcing strip 39 enters the chain guide unit 14, the arcuate head 31 of the feeler 28 is depressed out of the feed path 12 into the slot 27 by the central excessive portion 41 as shown in FIG. 8. The L-shaped sensor 29 is now caused to turn clockwise in the direction of the arrow a (FIG. 3) about the shaft 30 to enable the leg 32 to push the actuating arm 33 for thereby actuating the microswitch 34. The microswitch 34 then energizes a solenoid 42 (FIG. 4) electrically connected therewith for lowering a stop 43.

Figure 3:
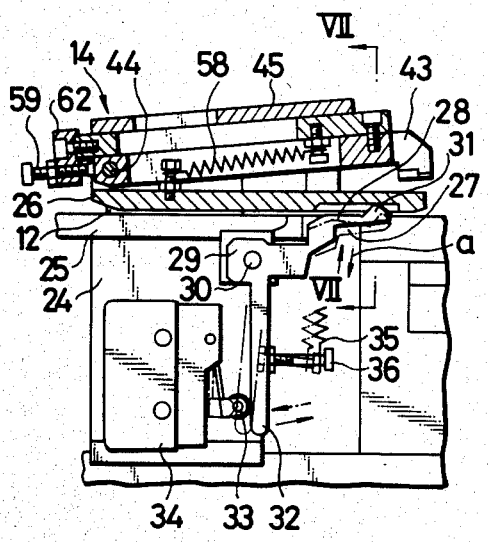
FIG. 3 is a vertical cross-sectional view of a chain guide unit, showing a sensor thereof.
Figure 4:
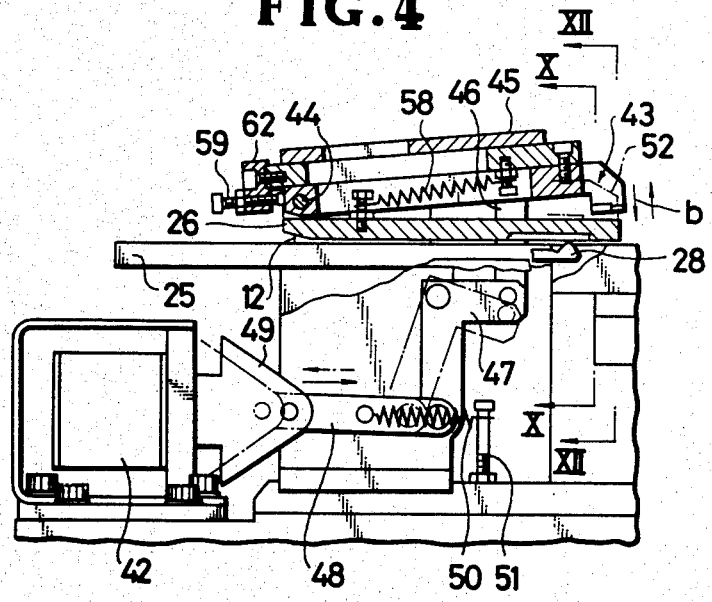
FIG. 4 is a vertical cross-sectional view of the chain guide unit, showing a stop operating mechanism thereof.

As shown in FIGS. 3 and 4, the stop 43 is slidably disposed in a frame 45 vertically angularly movably supported by a shaft 44 on a bracket (not shown) mounted on the casing 24. As illustrated in FIG. 4, the frame 45 is operatively coupled through pivotally interconnected links 46, 47, 48 to a plunger 49 of the solenoid 42. The frame 45 is normally urged to move upwardly by a spring 50 connected between the link 48 and a stud 51 fastened to the bottom of the casing 24. When the solenoid 42 is energized, the frame 45 is turned downwardly by the links 46, 47, 48 in the direction of the arrow b (FIG. 4) toward the position indicated by the dot-and-dash lines in FIG. 4.

Figure 5:
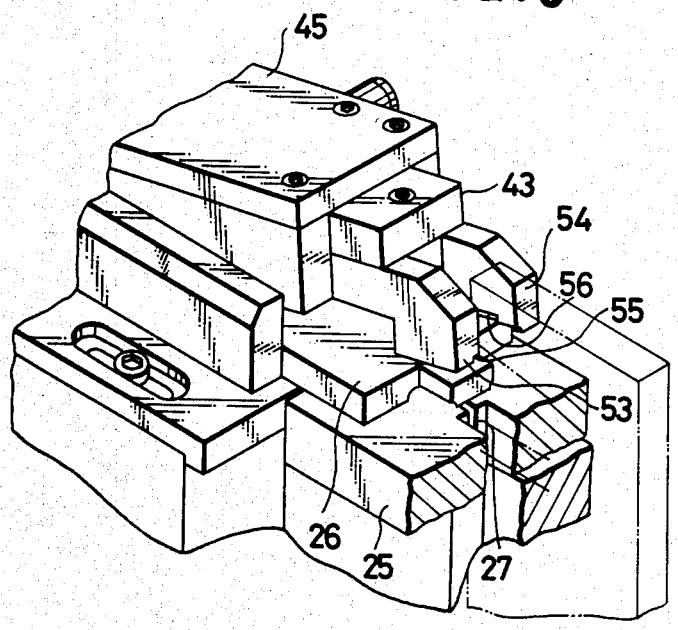
FIG. 5 is an enlarged fragmentary perspective view of the chain guide unit.
Figure 6:
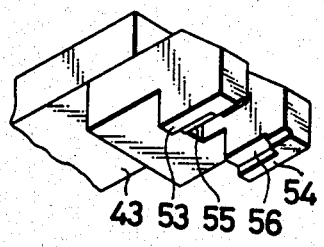
FIG. 6 is an enlarged fragmentary perspective view of a stop of the chain guide unit.
Figure 7:
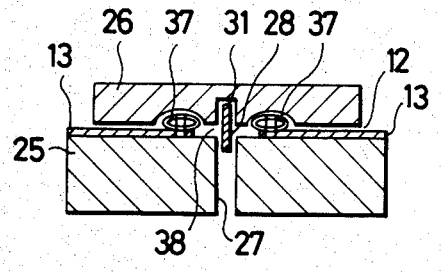
FIG. 7 is an enlarged cross-sectional view taken along line VII—VII of FIG. 3, illustrating upper and lower guide members.
Figure 10:
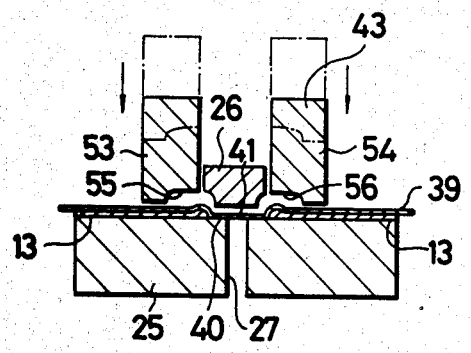
FIG. 10 is an enlarged cross-sectional view taken along line X—X of FIG. 4, showing the stop, the lower guide member, and the reinforcing strip.
Figure 11:
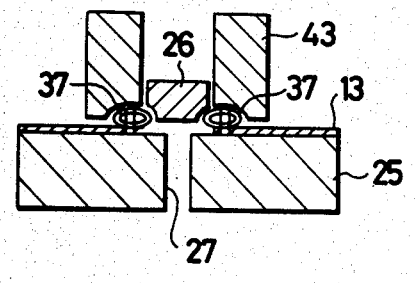
FIG. 11 is a view similar to FIG. 10, illustrating the stop, the lower guide member, and a portion of the slide fastener chain which is free from a reinforcing strip.
Figure 12:
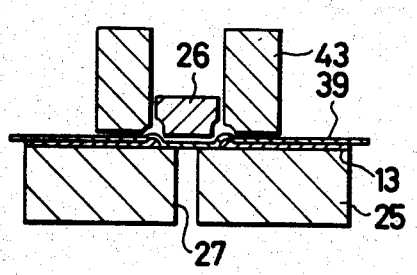
FIG. 12 is an enlarged cross-sectional view taken along line XII—XII of FIG. 4, showing the stop, the lower guide member, and the reinforcing strip.

As shown in FIGS. 5 and 6, the stopper 43 has a pair of laterally spaced noses 53, 54 positioned respectively over the coupling element rows 37, 37 of the slide fastener chain 13 as delivered along the feed path 12. The noses 53, 54 have a pair of recesses 55, 56, respectively, defined in lower surfaces thereof and held in vertical alignment with the coupling element rows 37, 37 (FIGS. 10 and 11). Each of the recesses 55, 56 has a step 57 (FIGS. 13 and 14) extending downwardly and serving as a stop surface as described below.

The stop 43 is normally urged by a spring 58 (FIGS. 3 and 4) to be retracted in a direction opposite to the direction in which the slide fastener chain 13 is delivered along the feed path 12.

Figure 13:
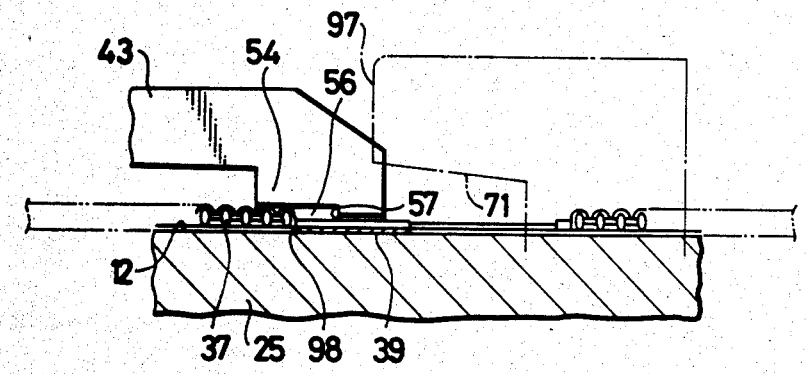
FIG. 13 is a vertical cross-sectional view, partly in side elevation, of the chain guide unit, showing the stopper, the lower guide member, and the slide fastener chain.

When the feeler 28 detects the reinforcing strip 39 on the slide fastener chain 13, the solenoid 42 is energized to lower the stop 43 toward the lower guide member 25 until some of the coupling elements 37 are accommodated in the recesses 55, 56 as shown in FIG. 13. Continued movement of the slide fastener chain 13 along the feed path 12 causes endmost or terminal coupling elements 63 (FIG. 14) of the coupling element rows 37 of a unit length to abut against the steps 57. The stop 43 is forced by the slide fastener chain 13 to move therewith in the direction of the arrow c (FIG. 9) while extending the spring 58.

As illustrated in FIGS. 2, 3, 4, and 9, a transverse bar 62 is secured at one end to the rear end of the stop 43 remote from the noses 54, 55. The transverse bar 62 supports on its other end an adjustable stop bolt 59 engagable with a microswitch 60 mounted on a support 61 attached to a side wall of the casing 24. When the stop 43 is forcibly slid by the slide fastener chain 13 as described above, the stop bolt 59 actuates the microswitch 60 and also stops further movement of the stop 43.

When the microswitch 60 is actuated, it produces a signal for operating the cutter unit 15 and the chain tensioner unit 16 and a signal for stopping the slide fastener chain 13 in the feed path 12.

As shown in FIGS. 1, 2, 15 through 18, the cutter unit 15 comprises a punch plate 70 having a central cutter 71 positioned between the noses 53, 54 of the stop 43, a pair of pressure pads 72, 73 positioned one on each side of the central cutter 71, a pair of side cutters 74, 75 positioned outwardly of the pressure pads 72, 73, respectively, and a die plate 76 positioned below the central cutter 71 and the side cutters 74, 75.

The punch plate 70 has a recess 77 (FIG. 16) defined in an upper portion thereof between an upper edge serving as the central cutter 71 and a lower edge 78 slanted for discharging chips cut off the reinforcing strips 39 by the central cutter 71. Also the punch plate 70 has in its opposite surfaces a pair of transverse guide grooves 70*a*, 70*a* (FIGS. 16–18) of semi-circular cross section opening to the recess 77 and receptive of the respective coupling element rows during the feeding of the chain. The punch plate 70 is vertically slidably fitted in a vertical guide slot 80 jointly defined in the die plate 76 and a support 79 on which the die plate 76 is supported.

Figure 15:
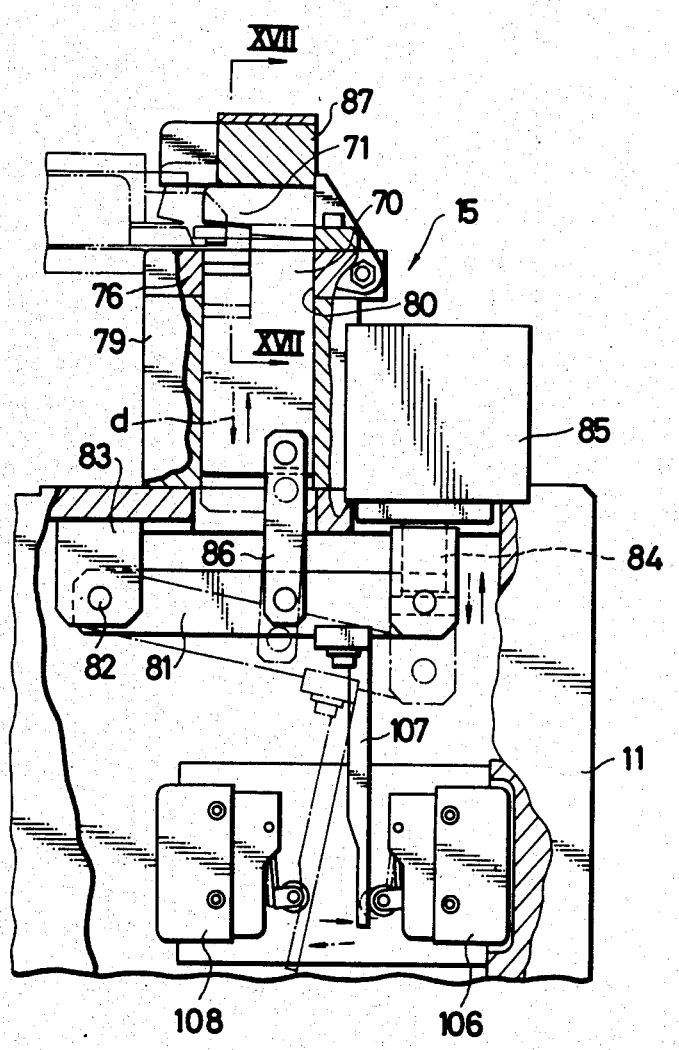
FIG. 15 is an enlarged side elevational view, partly cut away, of a cutter unit of the apparatus.
Figure 16:
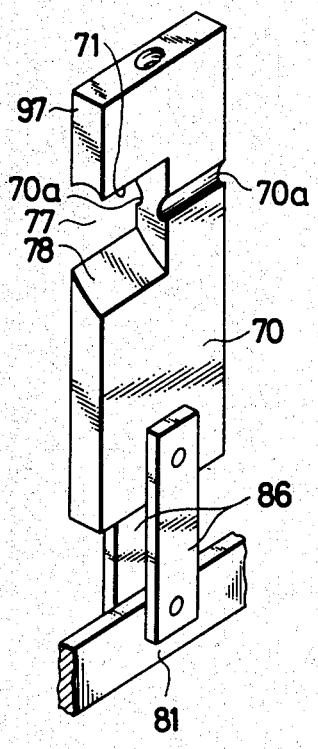
FIG. 16 is an enlarged perspective view of a punch plate of the cutter unit.
Figure 17:
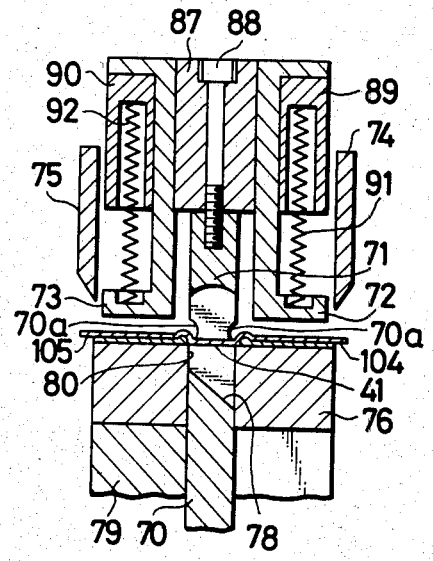
FIG. 17 is an enlarged cross-sectional view taken along line XVII—XVII of FIG. 15, showing the position of the parts prior to cutting off a reinforcing strip.
Figure 18:
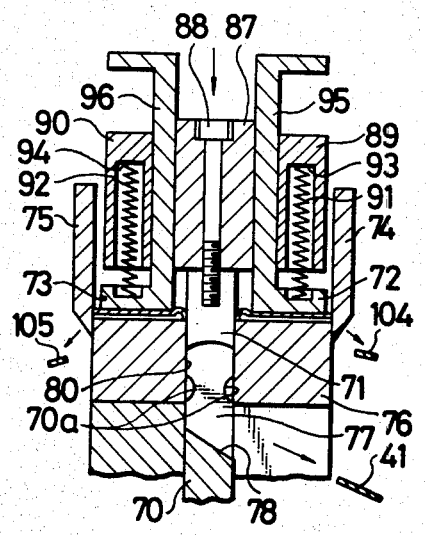
FIG. 18 is a view similar to FIG. 17, showing the position of the parts at the time of cutting off the reinforcing strip.

As shown in FIG. 15, a link 81 is vertically angularly movably supported at one end by a shaft 82 on a bracket 83 disposed in and attached to the base 11. The other end of the link 81 is pivotally coupled to a piston rod 84 of a pneumatic cylinder 85 mounted on the base 11. The punch plate 70 has a lower end pivotally coupled by a pair of links 86 to an intermediate portion of the link 81. The pneumatic cylinder 85 is actuated in response to actuation of the microswitch 60 to lower the piston rod 84 to cause the links 81, 86 to move the punch plate 70 downwardly in the direction of the arrow d for thereby enabling the central cutter 71 to cut off the central excessive portion 41 as shown in FIGS. 17 and 18.

A pad holder 87 is fastened by a bolt 88 to the upper end of the punch plate 70, the pad holder 87 having a pair of laterally spaced portions 89, 90. A pair of springs 91, 92 is disposed under compression between the pressure pads 72, 73 and the laterally spaced portions 89, 90 of the pad holder 87. The springs 91, 92 have upper end portions positioned respectively in downwardly opening holes 93, 94 defined in the laterally spaced portions 89, 90. The pressure pads 72, 73, each of a substantially C-shaped cross section, have vertically extending portions 95, 96 slidably supported in the pad holder 87, and are normally urged by the springs 91, 92 to move downwardly toward the die plate 76. When the punch plate 70 is located in its uppermost position as shown in FIG. 17, the pressure pads 72, 73 are biased downwardly by the springs 91, 92 to lie below the cutting blade of the central cutter 71.

For cutting off the reinforcing strip 39, the pneumatic cylinder 85 is actuated to lower the punch plate 70. Before the central cutter 71 engages the reinforcing strip 39, the pressure pads 72, 73 engage and clamp the slide fastener chain 13 and the reinforcing strip 39 against the upper surface of the die plate 76. Thereafter, the central cutter 71 engages the reinforcing strip 39 and cuts off the central excessive portion 41 as the central cutter 71 enters the guide slot 80, as shown in FIG. 18.

Figure 14:
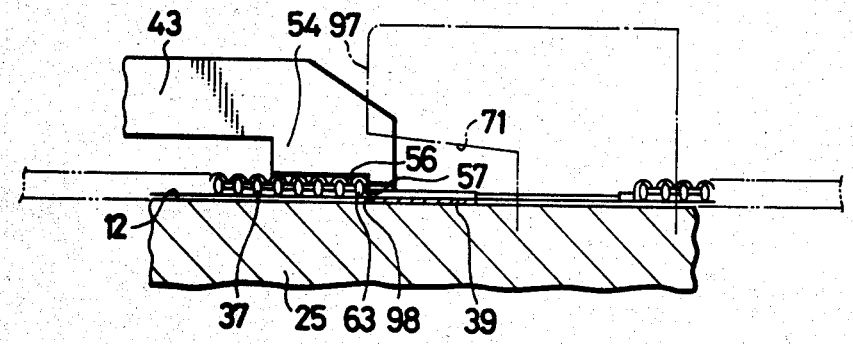
FIG. 14 is a view similar to FIG. 13, with the slide fastener chain shown as being slightly fed along from the position of FIG. 13.

As shown in FIGS. 13 and 14, the central cutter 71 is positioned just above the central excessive portion 41 when the endmost elements 63 are engaged by the steps 57 and the microswitch 60 is actuated. At this time, the central cutter 71 has its vertical end surface 97 aligned with an edge of the reinforcing strip 39, i.e., the edge W shown in FIG. 26.

As illustrated in FIG. 1, the side cutter 74 is swingably supported at an end 99 by a shaft 100 carried on the support block 22 and has a slot 102 defined in an opposite end 101. The side cutter 74 is coupled to the portion 89 of the pad holder 87 by a bolt 103 exteding through the slot 102. Although not shown, the side cutter 75 is likewise coupled to the portion 90 of the pad holder 87. Therefore, the side cutters 74, 75 are angularly vertically movable with the central cutter 71 for cutting off excessive side portions 104, 105 from the reinforcing strip 39 at the same time that the central excessive central 41 is severed, as shown in FIG. 18.

Where each reinforcing strip has no excessive side portions as shown in FIG. 25, the side cutters 74, 75 may be dispensed with.

As shown in FIG. 15, a vertical leg 107 is coupled to and extends downwardly from the link 81. When the punch plate 70 is moved upwardly and reaches its uppermost stroke end, the vertical leg 107 is in the solid-line position, actuating a microswitch 106 disposed in the base 11 for issuing a signal to restart feeding the slide fastener chain 13 in the feed path 12. Conversely, when the the punch plate 70 is moved downwardly and reaches its lowermost stroke end, the vertical leg 107 is in the dot-and-dash-line position, actuating a microswitch 108 disposed in the base 11 for issuing a signal to render the chain guide unit 14, the cutter unit 15, and the chain tensioner unit 16 inoperative.

Figure 19:
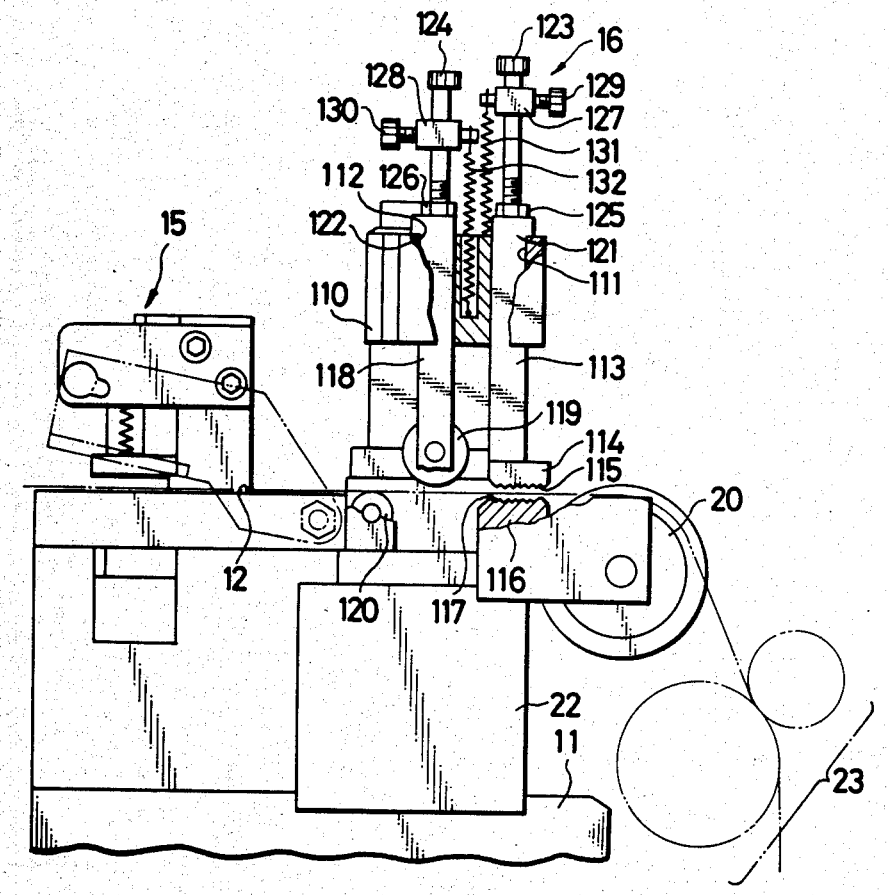
FIG. 19 is an enlarged side elevational view, partly broken away, of a chain tensioner unit of the apparatus, showing the inoperative position thereof.
Figure 20:
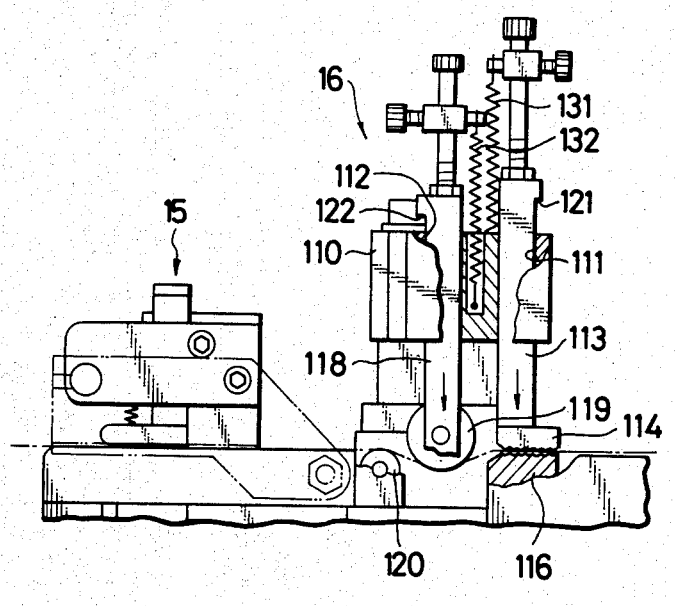
FIG. 20 is an enlarged side elevational view, partly broken away, of the chain tensioner unit as it is actuated.

FIGS. 19 and 20 illustrate the chain tensioner unit 16 in specific detail. The chain tensioner unit 16 includes an upper or second support block 110 movably mounted on the first support block 22, the upper support block 110 being vertically movable by a pneumatic cylinder (not shown). The upper support block 110 has a first vertical guide slot 111 closer to the guide roller 20 and a second vertical guide slot 112 parallel to the first guide slot 111 and closer to the cutter unit 15.

A vertical rod 113 having a presser gripper 114 on its lower end is vertically slidably fitted in the guide slot 111. The presser gripper 114 has gripping teeth 115 on its lower surface. A support base 116 on which the guide roller 20 is rotatably mounted is disposed on the support block 22 and is positioned downwardly of the presser gripper 114. The support base 116 has gripping teeth 117 on its upper surface in facing relation to the gripping teeth 115 of the presser gripper 114, the gripping teeth 117 being positioned in the feed path 12. A second rod 118 supporting a presser roller 119 on its lower end is vertically slidably fitted in the second guide slot 112. A support roller 120 is rotatably mounted on the support block 22 in the feed path 12 slightly upstream of the presser roller 119 in the direction in which the slide fastener chain 13 is fed. The presser roller 119 is positioned upstream of the presser gripper 114.

The vertical rods 113, 118 have downwardly facing steps 121, 122, respectively, engaging the upper surface of the upper support block 110, so that the vertical rods 113, 118 can be lifted by the upper support block 110 to raise the presser gripper 114 and the presser roller 119 clear out of the feed path 12.

A bolt 123 which is vertically adjustable in position is threaded in the upper end of the vertical rod 113 and is adjustably fixed thereto by a nut 125. Similarly, a vertically adjustable bolt 124 is threaded in the upper end of the second vertical rod 118 and is adjustably fixed thereto by a nut 126. A pair of springs retainers 127, 128 is positionally adjustably attached to the bolts 123, 124 by a pair of set screws 129, 130, respectively. The vertical rods 113, 118 are normally urged to move downwardly by a pair of springs 131, 132, respectively, acting between the spring retainers 127, 128 and the upper support block 110.

The, support block 110 is lowered from the position of FIG. 19 toward the position of FIG. 20 by its pneumatic cylinder when the microswitch 60 is actuated by the stop 43 of the chain guide unit 14. The presser gripper 114 is resiliently pressed against the support base 116 to firmly grip the slide fastener chain 13 therebetween. Simultaneously, the presser roller 119 resiliently depresses the slide fastener chain 13 between the support base 116 and the support roller 120. Therefore, the slide fastener chain 13 is strongly tensioned to forcibly press the endmost elements 63 (FIG. 14) against the steps 57 of the stop 43. The reinforcing strip 39 can accordingly be positioned accurately by the stop 43 with respect to the central cutter 71 and the side cutters 74, 75, and can be cut off or trimmed to a desired contour by the central cutter 71 and the side cutters 74, 75.

After the reinforcing strip 39 has been trimmed, the microswitch 108 is actuated to return the moving parts of the chain tensioner unit 16 to the position of FIG. 19.

The bolts 123, 124 and the spring retainers 127, 128 can be adjusted in their vertical position, and the springs 131, 132 can be replaced with those of different spring constants to achieve desired resilient forces with which the slide fastener chain 13 is gripped by the presser gripper 114 and tensioned by the presser roller 119 under the action of the springs 131, 132.

In operation, the slide fastener chain 13 is fed along the feed path 12 into the finishing apparatus 10. When one reinforcing strip 39 is detected by the feeler 28 of the chain guide unit 14, the stop 43 is lowered to cause the steps 57 of the stop 43 to engage the endmost coupling elements 63. After the stop 43 is slightly pulled by the slide fastener chain 13, the microswitch 60 generates a signal to stop the slide fastener chain 13. At the same time, the presser gripper 114 is lowered to hold the slide fastener chain 13 firmly against the support base 116. The presser roller 119 is also lowered to tension the slide fastener chain 13 to force the endmost coupling elements 63 against the steps 57 for thereby accurately positioning the reinforcing strip 39. Then, the pressure pads 72, 73 are lowered to hold the slide fastener chain 13 against the die plate 76, and the central and side cutters 71, 74, 75 descend to cut off the central excessive portion 41 and the side excessive portions 104, 105. After the reinforcing strip 39 is trimmed, the microswitch 108 is actuated to return the components of the chain guide unit 14, the cutter unit 15, and the chain tensioner unit 16 to their original or inoperative positions. Then, the slide fastener chain 13 is fed again along the feed path 12 in the finishing apparatus 10. The foregoing cycle of operation will be repeated to trim successive reinforcing strips 39.

In the aforesaid cycle of operation, the timing of operation of the cutter unit 15 and the chain tensioner unit 16 should be selected such that the chain tensioner unit 16 will be actuated first and then the cutter unit 15 will be actuated. Such operation timing can be achieved as by starting the pneumatic cylinders associated with the cutter unit 15 and the chain tensioner unit 16 at different times or designing the pneumatic cylinders to operate in different strokes.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An apparatus for finishing a slide fastener chain composed of a pair of slide fastener stringers having coupling element rows and a reinforcing strip attached to the slide fastener stringers transversely across an element-free space and including a central excessive portion lying in the element-free space adjacent to endmost coupling elements of the coupling element rows, said apparatus comprising:

(a) a base;

(b) means defining a feed path on said base along which the slide fastener chain can be fed;

(c) a chain guide unit on said base and including means partly defining said feed path, said chain guide unit including a sensor for detecting the reinforcing strip and a stop movable transversely into said feed path in response to detection of said reinforcing strip by said sensor, said stop including steps for engaging said endmost coupling elements, respectively, to stop said slide fastener chain;

(d) a cutter unit on said base and including a cutter movable transversely into said feed path for cutting off said central excessive portion from said reinforcing strip in response to engagement of said steps with said endmost coupling elements, and a pair of pressure pads disposed one on each side of said cutter of resiliently holding said slide fastener stringers in advance of the cutting of said central excessive portion by said cutter; and (e) a chain tensioner unit including a first support block on said base, a second support block vertically movably mounted on said first support block, a first vertical rod vertically slidably fitted in said second support block, a pressure gripper supported on a lower end of said first vertical block and movable transversely into said feed path for resiliently holding said slide fastener chain in response to engagement of said steps with said endmost coupling elements, a second vertical rod vertically slidably fitted in said second support block, a presser roller supported on a lower end of said second vertical rod, said pressure roller being disposed upstream of said pressure gripper and movable transversely into said feed path for tensioning said slide fastener chain in timed relation to said presser gripper to forcibly press said endmost coupling elements against said steps, said chain tensioner unit being positioned downstream of said cutter unit in the direction in which said slide fastener chain is fed along said feed path, whereby said reinforcing strip can be accurately positioned with respect to said cutter.

2. An apparatus according to claim 1, including a base and a casing mounted thereon, said means of said chain guide unit comprising a lower guide member mounted on said casing and an upper guide member mounted on said casing in vertically spaced relation to said lower guide member, said stop being angularly movably disposed upwardly of said upper guide member.

3. An apparatus according to claim 2, said stop having a pair of transversely spaced noses having a pair of recesses defined respectively therein for accommodating said coupling element rows, said recesses being partly defined by said steps.

4. An apparatus according to claim 1, including a base and a support base mounted thereon and having a vertical guide slot defined therein, said cutter unit comprising a punch plate vertically slidably disposed in said vertical guide slot, said punch plate having a hole defined between an upper edge serving as said cutter and a lower edge, and a die plate mounted on said support base for placing said slide fastener chain thereon.

5. An apparatus according to claim 4, said cutter unit including a pad holder fixed to said punch plate and having a pair of laterally spaced portions positioned upwardly of said die plate, said pressure pads being vertically slidably supported by said pad holder, and a pair of springs acting between said laterally spaced portions and said pressure pads for normally urging said pressure pads to move toward said die plate.

6. An apparatus according to claim 5, said cutter unit further including a pair of side cutters angularly movably coupled to said laterally spaced portions, respectively, for cutting off side excessive side portions of the reinforcing strip.

7. An apparatus according to claim 1, said chain tensioner unit further including a first bolt adjustably fastened to said first vertical rod, a second bolt adjustably fastened to said second vertical rod, a first spring retainer adjustably fixed to said first bolt, a second spring retainer adjustably fixed to said second bolt, a first spring coupled between said second support block and said first spring retainer for normally urging said presser gripper toward said feed path, and a second spring coupled between said second support block and said second spring retainer for normally urging said presser roller toward said feed path.

8. An apparatus according to claim 1, said chain tensioner unit further including a support base mounted on said first support block and positioned in said feed path in vertical alignment with said presser gripper, and a support roller rotatably supported on said first support block and positioned in said feed path upstream of said presser roller.

* * * * *